US010569545B2

(12) United States Patent
Takekoshi et al.

(10) Patent No.: US 10,569,545 B2
(45) Date of Patent: Feb. 25, 2020

(54) FLOW CHANNEL MEMBER, LIQUID EJECTING APPARATUS, AND METHOD FOR MANUFACTURING FLOW CHANNEL MEMBER

(71) Applicant: SEIKO EPSON CORPORATION, Tokyo (JP)

(72) Inventors: Taro Takekoshi, Shiojiri (JP); Tomoyuki Miyazawa, Matsumoto (JP); Masato Haga, Shiojiri (JP)

(73) Assignee: Siko Epson Corporation, Tokyo (JP)

( * ) Notice: Subject to any disclaimer, the term of this patent is extended or adjusted under 35 U.S.C. 154(b) by 0 days.

(21) Appl. No.: 16/217,634

(22) Filed: Dec. 12, 2018

(65) Prior Publication Data

US 2019/0184702 A1 Jun. 20, 2019

(30) Foreign Application Priority Data

Dec. 15, 2017 (JP) ..... 2017-240331

(51) Int. Cl.

| | |
|---|---|
| ***B41J 2/175*** | (2006.01) |
| ***B41J 2/14*** | (2006.01) |
| ***B41J 2/16*** | (2006.01) |
| ***B41J 29/02*** | (2006.01) |

(52) U.S. Cl.

CPC ..... *B41J 2/1433* (2013.01); *B41J 2/162* (2013.01); *B41J 2/1634* (2013.01); *B41J 2/175* (2013.01); *B41J 2/17509* (2013.01); *B41J 29/02* (2013.01)

(58) Field of Classification Search

CPC ..... B41J 2/1433; B41J 2/162; B41J 2/1634; B41J 2/175; B41J 2/17509

See application file for complete search history.

(56) References Cited

U.S. PATENT DOCUMENTS

| | | | | |
|---|---|---|---|---|
| 2011/0083758 | A1* | 4/2011 | Tsujiuchi | B29C 65/1635 137/561 R |
| 2011/0310189 | A1* | 12/2011 | Kanbe | B41J 2/17513 347/86 |
| 2017/0021613 | A1 | 1/2017 | Hanagami et al. | |
| 2017/0157929 | A1* | 6/2017 | Yokoo | B41J 2/14145 |

FOREIGN PATENT DOCUMENTS

| | | |
|---|---|---|
| JP | 2005-271315 A | 10/2005 |
| JP | 2017-024322 A | 2/2017 |
| JP | 2017-024387 A | 2/2017 |

* cited by examiner

*Primary Examiner* — Jason S Uhlenhake

(74) *Attorney, Agent, or Firm* — Workman Nydegger

(57) ABSTRACT

There is provided a flow channel member in which a flow channel of a liquid is formed by a plurality of flow channel forming members, the flow channel member including: a first flow channel forming member that includes a light absorbing member having absorbing properties with respect to laser light; a second flow channel forming member that includes a light transmitting member having transmitting properties with respect to the laser light and is welded to a first surface of the first flow channel forming member; and a third flow channel forming member that includes a light transmitting member having transmitting properties with respect to the laser light and is welded to a second surface of the first flow channel forming member. The first surface and the second surface are provided at positions where planes along the both surfaces intersect with each other.

8 Claims, 10 Drawing Sheets

FLOW CHANNEL MEMBER, LIQUID EJECTING APPARATUS, AND METHOD FOR MANUFACTURING FLOW CHANNEL MEMBER

BACKGROUND

1. Technical Field

The present invention relates to a flow channel member that forms a flow channel of a liquid, a liquid ejecting apparatus that includes the flow channel member, and a method for manufacturing a flow channel member.

2. Related Art

JP-A-2017-24387 discloses a flow channel structure including a flow channel formed by welding a light absorbing member and a light transmitting member as an example of a flow channel member by laser light.

In the flow channel structure disclosed in JP-A-2017-24387, it is possible to visually recognize an inside of a flow channel from a side facing a light transmitting member. In other words, in the flow channel structure, it is possible to visually recognize the inside of the flow channel from only the side facing the light transmitting member.

SUMMARY

An advantage of some aspects of the invention is to provide a flow channel member, a liquid ejecting apparatus, and a method for manufacturing the flow channel member in which it is possible to visually recognize an inside of a flow channel in a plurality of directions.

According to an aspect of the invention, there is provided a flow channel member in which a flow channel of a liquid is formed by a plurality of flow channel forming members, the flow channel member including: a first flow channel forming member that includes a light absorbing member having absorbing properties with respect to laser light; a second flow channel forming member that includes a light transmitting member having transmitting properties with respect to the laser light and is welded to a first surface of the first flow channel forming member to form a first flow channel that is a downstream-side part of the flow channel; and a third flow channel forming member that includes a light transmitting member having transmitting properties with respect to the laser light and is welded to a second surface of the first flow channel forming member to form a second flow channel that is an upstream-side part of the flow channel. The first surface and the second surface are provided at positions where planes along the both surfaces intersect with each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings. For example, the liquid ejecting apparatus is an ink jet printer that ejects ink, which is an example of a liquid on a medium such as a sheet of paper, and records an image such as a character or a picture.

Figure 1:
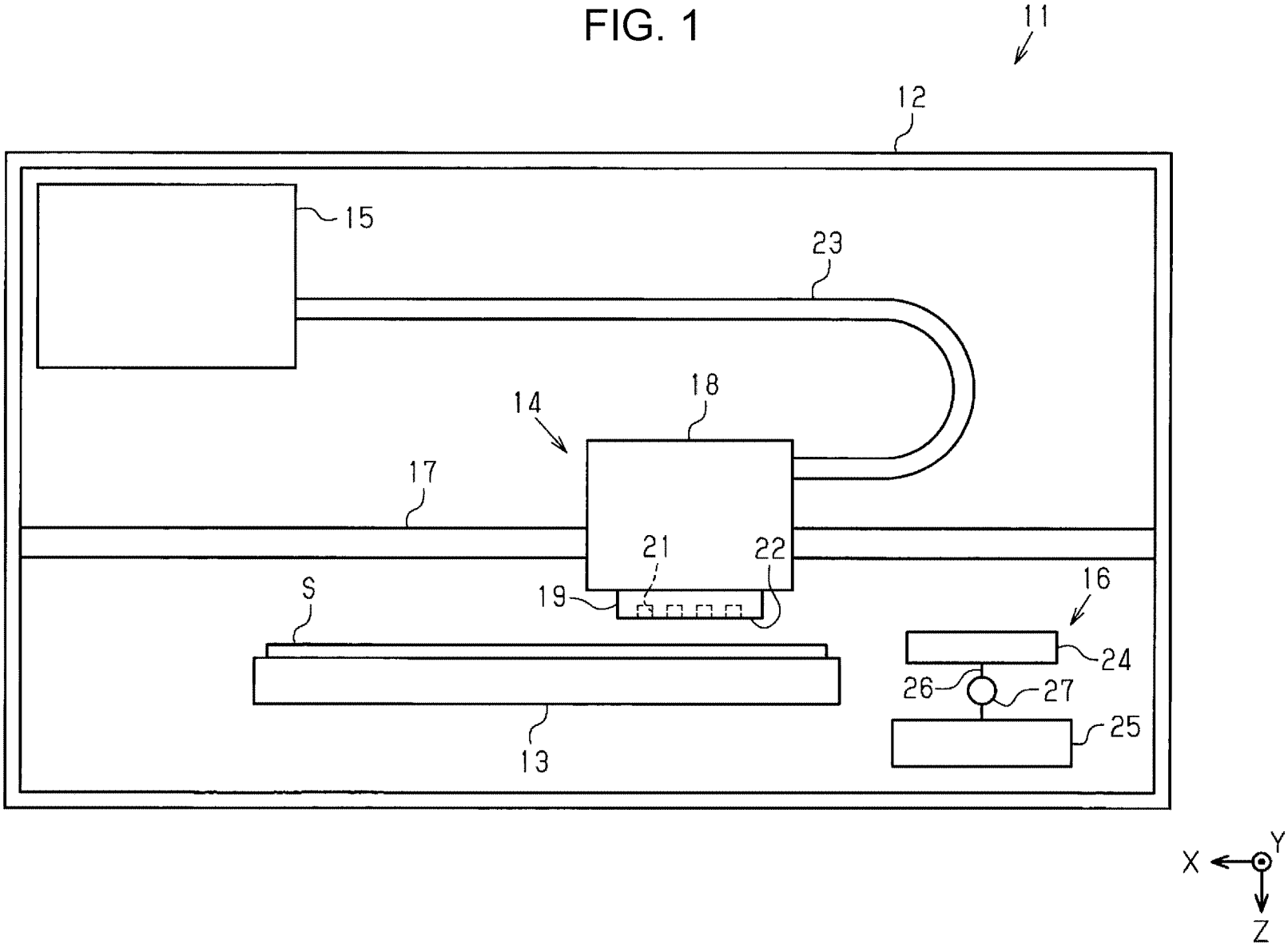
FIG. 1 is a front view schematically illustrating an embodiment of a liquid ejecting apparatus.

As illustrated in FIG. 1, a liquid ejecting apparatus 11 includes a housing 12, a support base 13 that supports a medium S, and a liquid ejecting unit 14 that ejects a liquid. The liquid ejecting apparatus 11 includes a liquid container 15 that contains the liquid and a discharging mechanism 16 that executes maintenance of the liquid ejecting unit 14. The support base 13, the liquid ejecting unit 14, the liquid container 15, and the discharging mechanism 16 are positioned in the housing 12.

The housing 12 has a rectangular parallelepiped shape in which a width direction X is a longitudinal direction. The support base 13 is disposed close to the center in the width direction X and close to a lower side in a vertical direction Z in the housing 12. For example, the support base 13 supports the medium S that is transported in the housing 12 in a transport direction Y. The transport direction Y is a direction which is different from the width direction X and the vertical direction Z. For example, the liquid ejecting apparatus 11 transports the medium S to the support base 13 from a cassette, a tray, or the like which enables the medium S to be set.

The liquid ejecting unit 14 is positioned above the support base 13 in the housing 12. The liquid ejecting unit 14 includes a guide shaft 17 extending in the width direction X in the housing 12, a carriage 18 that is supported by the guide shaft 17, and a liquid ejecting head 19 that is mounted on the carriage 18. The carriage 18 is reciprocable along the guide shaft 17. The liquid ejecting head 19 is provided with nozzles 21 for ejecting the liquid. In the liquid ejecting head 19, a surface, in which the nozzles 21 are formed, is set as a nozzle surface 22. The nozzle surface 22 is a surface facing the support base 13 during printing. While the liquid ejecting head 19 moves together with the carriage 18, the liquid ejecting head 19 ejects the liquid from the nozzles 21 to the medium S that is supported by the support base 13.

The liquid container 15 is positioned close to one end in the X direction and close to an upper side in the vertical direction Z in the housing 12. The liquid container 15 contains the liquid that is to be ejected by the liquid ejecting unit 14. The liquid container 15 may be configured to be able to be attached to and detached from the housing 12 or may be configured to be able to be refilled with the liquid from outside.

The liquid container 15 is connected with the liquid ejecting head 19 via a supply flow channel 23. The supply flow channel 23 is a flow channel for supplying the liquid contained in the liquid container 15 to the liquid ejecting unit 14. For example, the supply flow channel 23 is a flexible tube. In this case, the supply flow channel 23 is deformed in response to movement of the liquid ejecting head 19.

The discharging mechanism 16 is positioned to be adjacent to the support base 13 in the width direction X. The discharging mechanism 16 includes a cap 24 that performs capping of the liquid ejecting head 19 and a waste tank 25 that contains, as a waste liquid, a liquid that is ejected from the liquid ejecting head 19. The discharging mechanism 16 includes a waste flow channel 26 that connects the cap 24 with the waste tank 25 and a pump 27 that is disposed at a position on the waste flow channel 26. Capping means forming a space including the nozzles 21 by causing the cap 24 to come into contact with the liquid ejecting head 19.

When the discharging mechanism 16 executes maintenance of the liquid ejecting head 19, the liquid ejecting head 19 moves toward a position right above the discharging mechanism 16. Next, the cap 24 approaches the liquid ejecting head 19 and performs capping of the liquid ejecting head 19. In this case, the capping may be performed by causing the liquid ejecting head 19 to approach the cap 24.

When the pump 27 is driven in a state in which the cap 24 performs capping of the liquid ejecting head 19, a pressure in a space in the cap 24 becomes the negative pressure. Consequently, the liquid is forcibly discharged from the nozzles 21. The liquid discharged into the cap 24 is contained in the waste tank 25 through the waste flow channel 26. Such an operation is referred to as cleaning. In other words, the discharging mechanism 16 executes suction cleaning of the liquid ejecting head 19.

In the embodiment, a home position is a position of the liquid ejecting head 19 that can be subjected to capping by the cap 24, in the width direction X. In the width direction X, a position on an opposite side to the home position is set as an opposite home position. In the width direction X, the discharging mechanism 16 is positioned close to the home position, and the liquid container 15 is positioned close to the opposite home position.

For example, the liquid ejecting apparatus 11 pressurizes the liquid in the liquid ejecting head 19, thereby, executing pressurization cleaning of discharging the liquid from the nozzles 21, in some case. The liquid that is discharged by the pressurization cleaning may be received by the cap 24 of the discharging mechanism 16 or may be received by another member.

In order to suppress thickening or solidifying of the liquid in the nozzles 21, the liquid ejecting apparatus 11 executes flushing of ejecting a liquid unrelated to printing from the nozzles 21, in some cases. The liquid that is discharged by the flushing may be received by the cap 24 of the discharging mechanism 16 or may be received by another member.

When the liquid is discharged from the nozzles 21 by the suction cleaning, the pressurization cleaning, or the like, the nozzle surface 22 is stained with the liquid. Therefore, the liquid ejecting apparatus 11 may include a wiping unit that comes into contact with and wipes the nozzle surface 22. For example, the wiping unit is configured of a rubber wiper or a cloth wiper.

Figure 2:
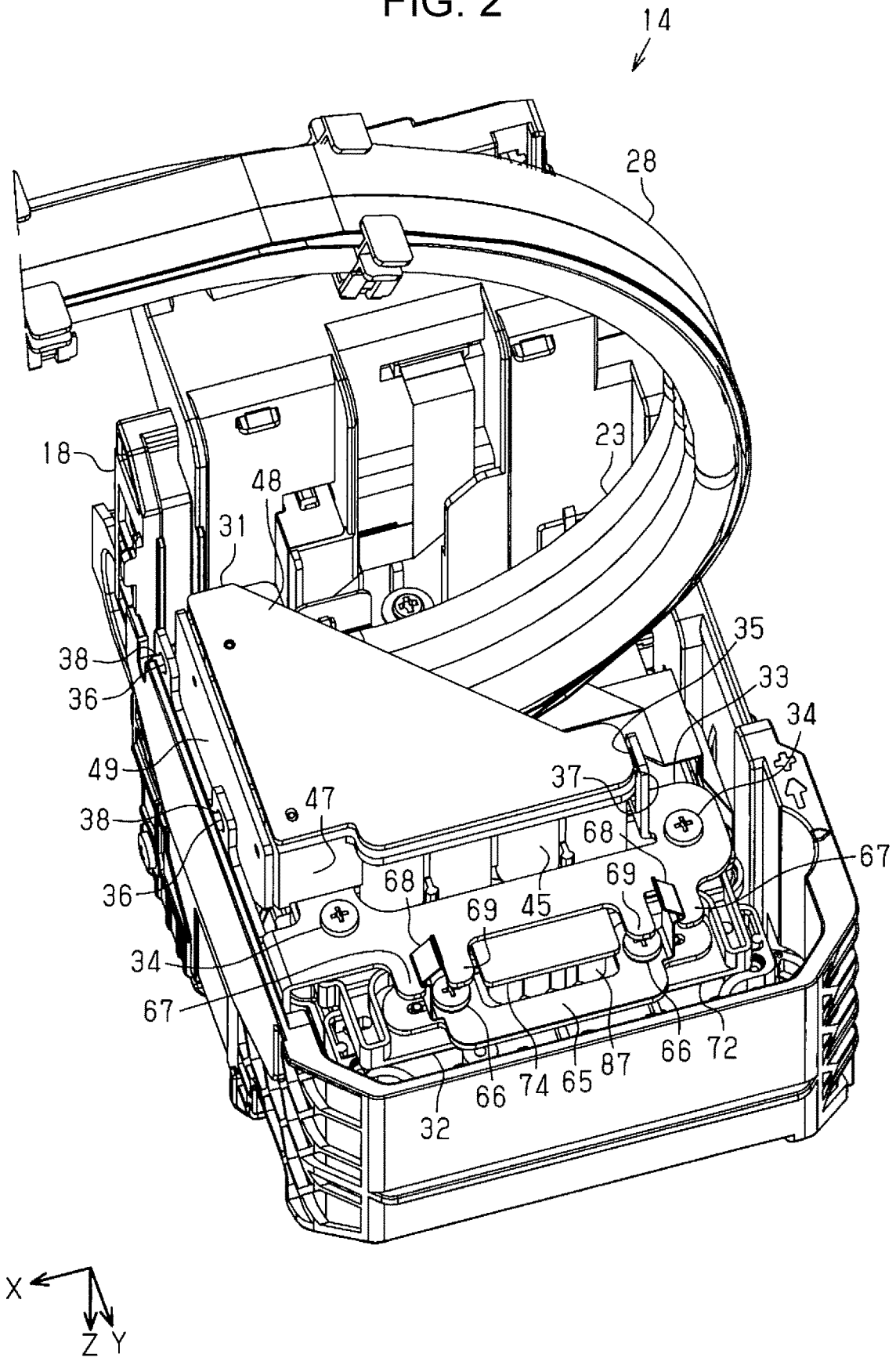
FIG. 2 is a perspective view of a carriage.

As illustrated in FIG. 2, a flow channel member 31 and a connection member 32 are attached to the carriage 18. The carriage 18 is configured to have a case shape having an upper portion that is open. The carriage 18 may has a cover for covering the open upper portion.

The flow channel member 31 and the connection member 32 are positioned in the carriage 18. The flow channel member 31 connects the connection member 32 with the supply flow channel 23 in the carriage 18. The connection member 32 is connected with the flow channel member 31 and the liquid ejecting head 19 in the carriage 18. Therefore, the liquid that is supplied from the supply flow channel 23 is supplied to the liquid ejecting head 19 via the flow channel member 31 and the connection member 32.

The supply flow channel 23 extends toward an inside of the carriage 18. A plurality of supply flow channels 23 are provided, and four supply flow channels are provided in the embodiment. The supply flow channels 23 supply different types of liquid from each other. Therefore, in the embodiment, four liquid containers 15 are provided to correspond to the supply flow channels 23 and contain different types of respective liquids. For example, the supply flow channels 23 supply black ink, cyan ink, magenta ink, and yellow ink, respectively. The number of supply flow channels 23 is not limited to four and may be three or less or five or more. The plurality of supply flow channels 23 may not be provided. For example, one supply flow channel may be provided. A flexible cable 28 for supply electricity to the liquid ejecting head 19 is attached to the carriage 18. The flexible cable 28 extends to be along the supply flow channel 23 toward the inside of the carriage 18.

Figure 3:
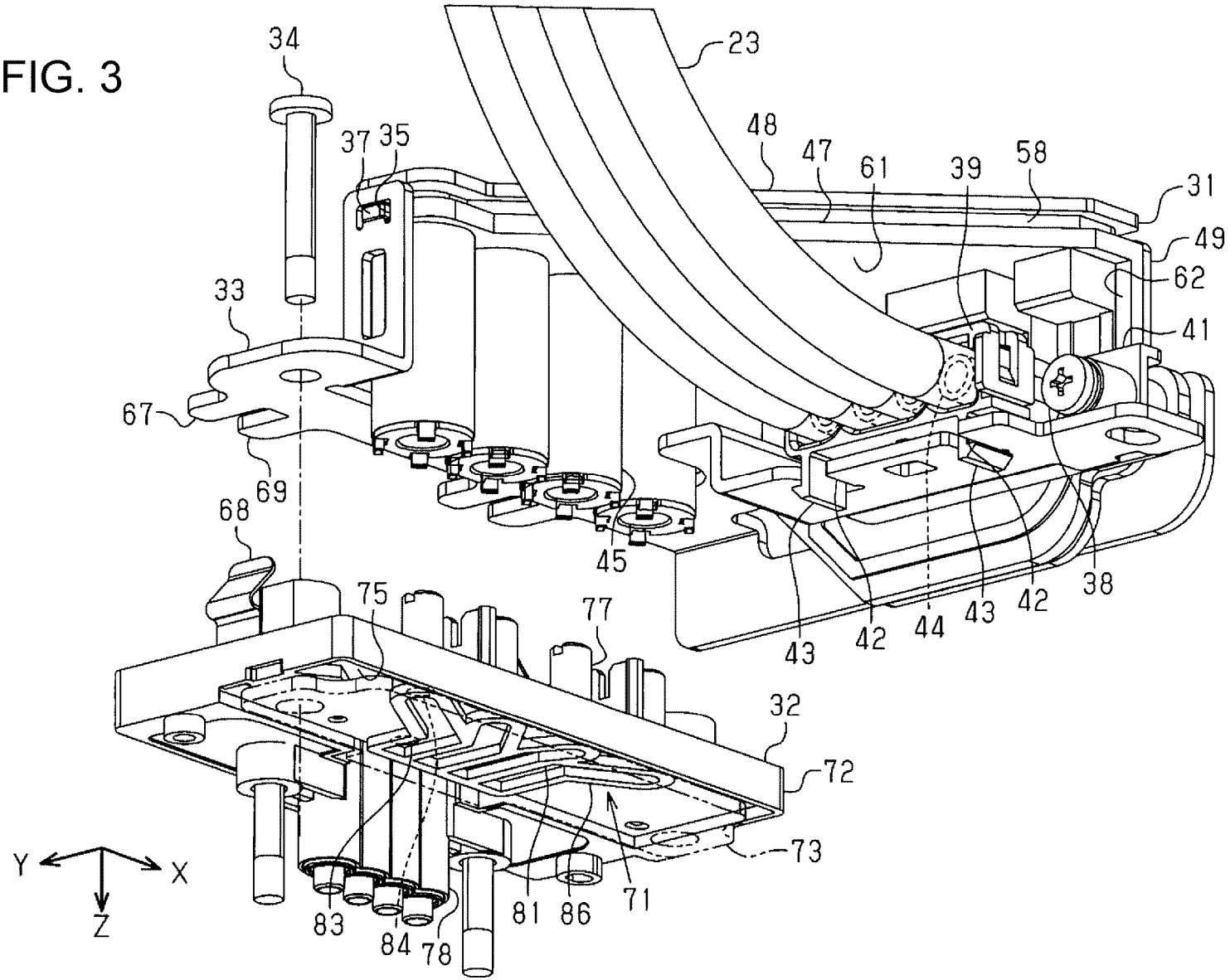
FIG. 3 is a perspective view of a flow channel member and a connection member.

As illustrated in FIGS. 2 and 3, the flow channel member 31 is held by a holder 33. The flow channel member 31 is attached to the carriage 18 via the holder 33. The holder 33 may be configured of sheet metal. In this case, the holder 33 also functions as a reinforcing plate for reinforcing the flow channel member 31. The holder 33 is fixed to the carriage 18 with a screw 34. The flow channel member 31 is detached from the holder 33 and the carriage 18 by removing the screw 34. The screw 34 is located at an easily recognizable position when the inside of the carriage 18 is viewed from above.

The holder 33 is provided with a first hole 35 and a second hole 36 for holding the flow channel member 31. The first hole 35 and the second hole 36 are positioned to sandwich the flow channel member 31 in the width direction X. The first hole 35 is positioned close to the home position in the width direction X. The second hole 36 is positioned close to the opposite home position in the width direction X. The flow channel member 31 is provided with a protrusion 37 that is inserted into the first hole 35. In order to hold the flow channel member 31, a screw 38 is inserted into the second hole 36.

An end portion of the supply flow channel 23 that is connected to the flow channel member 31 is provided with a holding body 39 for holding the supply flow channels in a state in which the plurality of supply flow channels 23 are disposed side by side and a connection body 41 for connecting the supply flow channel with the flow channel member 31. The plurality of supply flow channels 23 can be integrally handled by the holding body 39. The supply flow channels 23 are connected with the flow channel member 31 via the connection body 41.

The holder 33 is provided with a notch 42 for holding the holding body 39. The holding body 39 is provided with a hook 43 that is capable of being hooked into the notch 42. The hook 43 is hooked into the notch 42, thereby the holding body 39 has a stable posture with respect to the holder 33. When the supply flow channel 23 is attached to the flow channel member 31, the holding body 39 has a configuration in which the hook 43 is hooked into the notch 42.

For example, the connection body 41 has a sealing member for sealing the supply flow channel 23 and the flow channel member 31. The connection body 41 is attached to the supply flow channel 23 and the flow channel member 31, thereby, sealing both. The connection body 41 is fixed to the flow channel member 31 with the screw 38 with which the holder 33 holds the flow channel member 31.

As illustrated in FIG. 3, the flow channel member 31 has an upstream-side connecting portion 44 for allowing the supply flow channel 23 to be connected. The upstream-side connecting portion 44 is connected to one end of the supply flow channel 23 of which the other end is connected to the liquid container 15. The supply flow channel 23 functions as a first connection flow channel that connects the liquid container 15 with the flow channel member 31.

The flow channel member 31 has a downstream-side connecting portion 45 for allowing the connection member 32 to be connected. The downstream-side connecting portion 45 is connected to one end of the connection member 32 of which the other end is connected to the liquid ejecting head 19. The connection member 32 functions as a second connection flow channel that connects the flow channel member 31 with the liquid ejecting head 19.

Figure 4:
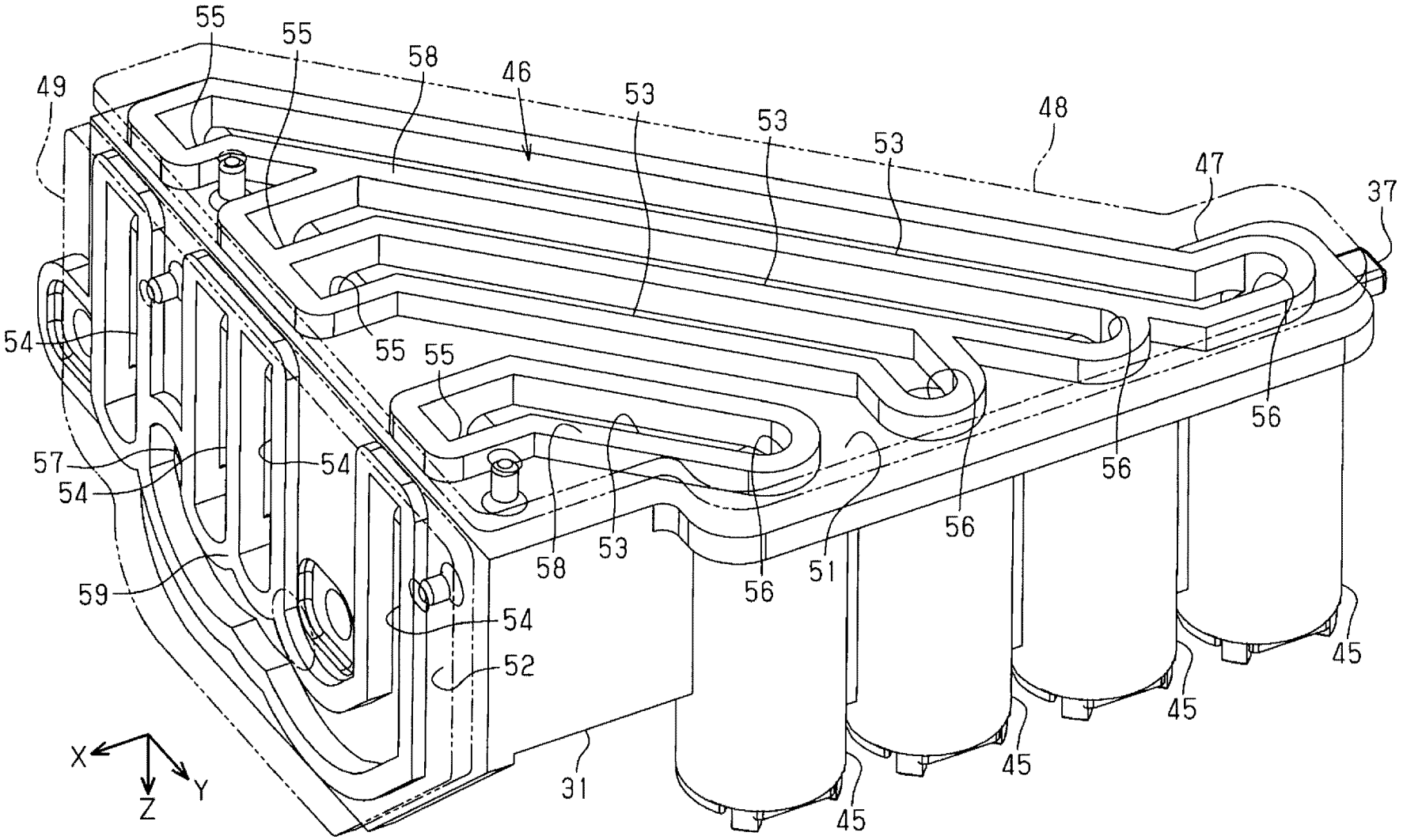
FIG. 4 is a perspective view of the flow channel member.
Figure 5:
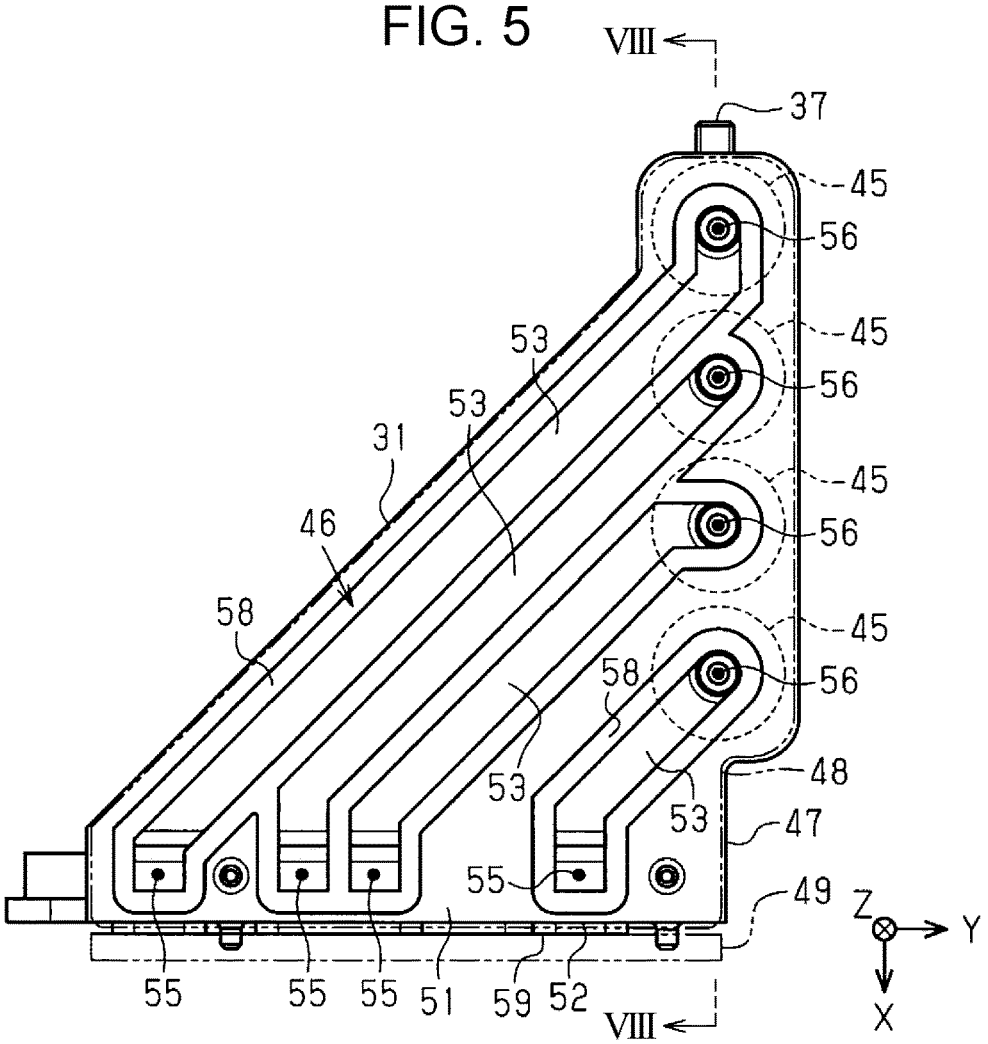
FIG. 5 is a front view of a first surface in the flow channel member.
Figure 6:
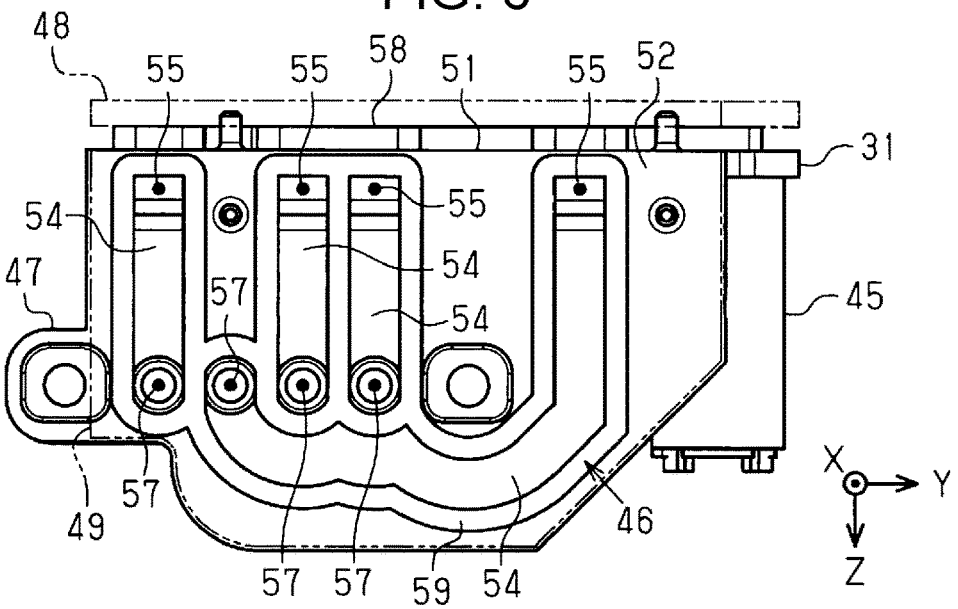
FIG. 6 is a front view of a second surface in the flow channel member.

As illustrated in FIGS. 4, 5, and 6, the flow channel member 31 has a flow channel 46 of a liquid. The flow channel 46 configures at least a part of a flow channel for supplying the liquid to the liquid ejecting head 19. The flow channel member 31 has a first flow channel forming member 47, a second flow channel forming member 48, and a third flow channel forming member 49.

The second flow channel forming member 48 and the third flow channel forming member 49 are attached to the first flow channel forming member 47. The second flow channel forming member 48 is welded to a first surface 51 of the first flow channel forming member 47. The third flow channel forming member 49 is welded to a second surface 52 of the first flow channel forming member 47. The first surface 51 and the second surface 52 are provided so as to cause respective planes along the first surface 51 and the second surface 52 to intersect with each other in the first flow channel forming member 47. In other words, the first surface 51 and the second surface 52 face different directions from each other.

The second flow channel forming member 48 and the third flow channel forming member 49 are laser-welded to the first flow channel forming member 47 with laser light. The first flow channel forming member 47 is configured of a light absorbing member having absorbing properties with respect to the laser light. The second flow channel forming member 48 and the third flow channel forming member 49 are configured of a light transmitting member having transmitting properties with respect to laser light. The first flow channel forming member 47 has higher absorbing properties with respect to the laser light than at least the second flow channel forming member 48 and the third flow channel forming member 49. The second flow channel forming member 48 and the third flow channel forming member 49 have higher transmitting properties with respect to the laser light than at least the first flow channel forming member 47.

For example, a black resin is preferably employed as the light absorbing member. For example, as the light absorbing member, it is possible to employ a member obtained by mixing a predetermined colorant such as carbon black, a dye, or a pigment with polyamide (PA), polyethylene (PE), polypropylene (PP) or the like. For example, a transparent or translucent resin is preferably employed as the light transmitting member. The first surface 51 and the second surface 52 of the first flow channel forming member 47 is visually recognizable through the second flow channel forming member 48 and the third flow channel forming member 49 which have the transmitting properties. Bubbles in addition to the liquid flows in the flow channel 46, in some cases. It is possible to visually recognize the first surface 51 and the second surface 52, and thereby it is possible to visually recognize bubbles in the flow channel 46.

When bubbles in the flow channel 46 flows into the nozzles 21, it is not possible to perform normal ejection of the liquid, and this results in an influence on print quality. Therefore, in a case where an image is printed on the medium S, it is preferable that the bubbles do not flow into the liquid ejecting head 19. In a case where there are bubbles in the flow channel 46, pressurization cleaning, suction cleaning, or the like may be executed. When the pressurization cleaning, the suction cleaning, or the like is executed, the bubbles are ejected together with the liquid from the nozzles 21.

For example, as the light transmitting member, it is possible to employ polyamide (PA), polyethylene (PE), polypropylene (PP), polyethylene terephthalate (PET), polystyrene (PS), styrene-acrylonitrile copolymer, ABS resin, acrylic resin (PMMA), polycarbonate (PC), polybutylene terephthalate (PBT), or the like. A resin material obtained by adding reinforcing fiber such as glass fiber or carbon fiber or a colorant may be used, as necessary.

When the second flow channel forming member 48 is welded to the first surface 51 of the first flow channel forming member 47, a first flow channel 53, which is a downstream-side part of the flow channel 46, is formed. When the third flow channel forming member 49 is welded to the second surface 52 of the first flow channel forming member 47, a second flow channel 54, which is an upstream-side part of the flow channel 46, is formed. In other words, in the flow channel member 31, the flow channel 46 of the liquid is formed by the plurality of flow channel forming members 47, 48, and 49. The first flow channel 53 is formed by extending along the first surface 51. The second flow channel 54 is formed by extending along the second surface 52. Therefore, the flow channel member 31 is configured to enabling movement of bubbles, which moves in different directions in the flow channel 46, to be visually recognizable.

The first flow channel 53 and the second flow channel 54 are continuous through a through-channel 55 included in the first flow channel forming member 47. The through-channel 55 is positioned on an upstream end of the first flow channel 53 and a downstream end of the second flow channel 54. A downstream connecting channel 56 that communicates with the downstream-side connecting portion 45 is provided at a downstream end of the first flow channel 53. An upstream connecting channel 57 that communicates with the upstream-side connecting portion 44 is provided at an upstream end of the second flow channel 54. The downstream-side connecting portion 45 communicates with the downstream side of the first flow channel 53 by the downstream connecting channel 56. The upstream-side connecting portion 44 communicates with the upstream side of the second flow channel 54 by the upstream connecting channel 57.

The downstream connecting channels 56 are arranged side by side in a row on the first surface 51. The upstream connecting channels 57 are arranged side by side in a row on the second surface 52. The downstream connecting channels 56 are disposed side by side at intervals larger than those of the upstream connecting channels 57. When the first flow channel 53 and the second flow channel 54 are formed so as to cause arrangement of the downstream connecting channels 56 to be different from arrangement of the upstream connecting channels 57, it is possible to change arrangement of liquids that flows in the flow channels 46 at any position from the liquid container 15 toward the liquid ejecting head 19. For example, in a case where liquids flow side by side in an order of black, cyan, magenta, and yellow in the supply flow channels 23, it is possible to change arrangement of the liquids by the flow channel member 31 so that the liquids flow in an order of black, magenta, yellow, and cyan in the connection members 32. The flow channel member 31 of the embodiment is configured so as to allow the arrangement of the upstream connecting channels 57 to be different from arrangement of the through-channels 55.

The first surface 51 and the second surface 52 are provided with ribs 58 and 59 which project perpendicularly. The ribs 58 and 59 extend to have an annular shape on the first surface 51 and the second surface 52, respectively. The second flow channel forming member 48 and the third flow channel forming member 49 are welded to distal ends of the ribs 58 and 59, respectively, with respect to the first flow channel forming member 47. Therefore, distal end surfaces of the ribs 58 and 59 are welded surfaces of the first flow channel forming member 47 with respect to the second flow channel forming member 48 and the third flow channel forming member 49. The distal end surfaces of the ribs 58 are a part of the first surface 51. The distal end surfaces of the ribs 59 are a part of the second surface 52. The second flow channel forming member 48 is welded to the ribs 58, and thereby the first flow channels 53 that are surrounded by the ribs 58 are formed. The third flow channel forming member 49 is welded to the ribs 59, and thereby the second flow channels 54 that are surrounded by the ribs 59 are formed.

It is preferable that the flow channel member 31 be attached to the carriage 18 so that the first surface 51 becomes a surface facing upward in the vertical direction Z. In this manner, in a case where the inside of the housing 12 is looked into from above, it is easy to view the first surface 51 of the flow channel member 31, and thus it is easy to visually recognize the inside of the first flow channels 53.

It is preferable that the flow channel member 31 be attached to the carriage 18 so that the first surface 51 is positioned above the second surface 52 in the vertical direction Z. In this case, the second flow channels 54 which are provided on the second surface 52 extend from the lower side toward the upper side in the vertical direction Z. Consequently, bubbles in the second flow channel 54 are likely to flow to the first flow channel 53 due to buoyance. As a result, the bubbles in the flow channels 46 are likely to be gathered in the first flow channels 53. The bubbles are gathered in the first flow channels 53, and thereby it is possible to visually recognize the bubbles in the flow channels 46 from the first surface 51.

The flow channel member 31 of the embodiment is attached to the carriage 18 so that the first surface 51 is horizontal. Therefore, the first flow channel 53 provided on the first surface 51 extends horizontally, and the second flow channel 54 provided on the second surface 52 extends horizontally. The second flow channel 54 extends from the lower side toward the upper side from downstream to upstream. The first flow channel 53 extends from a side, on which the second surface 52 is positioned, toward an opposite side thereof, that is, from a side of the opposite home position toward a side of the home position in the width direction X, from upstream to downstream.

As illustrated in FIGS. 3 and 4, the downstream-side connecting portion 45 is provided to the first flow channel forming member 47. It is preferable that the downstream-side connecting portion 45 be positioned below the first surface 51 in the vertical direction Z. In this manner, the bubbles in the first flow channel 53 is unlikely to flow to a side of the liquid ejecting head 19 through the downstream-side connecting portion 45. In other words, it is possible to accumulate the bubbles in the first flow channel 53.

The downstream-side connecting portion 45 is provided on a fourth surface 61 that is a surface of the first flow channel forming member 47 on an opposite side to the first surface 51. The downstream-side connecting portion 45 extends perpendicularly from the fourth surface 61. The downstream-side connecting portion 45 of the embodiment is provided to have a cylindrical shape and extends from the fourth surface 61 toward the lower side in the vertical direction Z.

The upstream-side connecting portion 44 is provided in the first flow channel forming member 47. The upstream-side connecting portion 44 may be provided on a third surface 62 on an opposite side to the second surface 52 in the first flow channel forming member 47. In this case, since the upstream-side connecting portion 44 extends horizontally, bubbles in an upstream region from the flow channel member 31, for example, bubbles in the supply flow channel 23, are likely to flow to the second flow channel 54. As a result, the bubbles in the flow channel 46 is likely to be visually recognized. The upstream-side connecting portion 44 extends perpendicularly from the third surface 62. The upstream-side connecting portion 44 of the embodiment is provided to have a cylindrical shape and extends from the side of the opposite home position toward the side of the home position in the width direction X.

Figure 7:
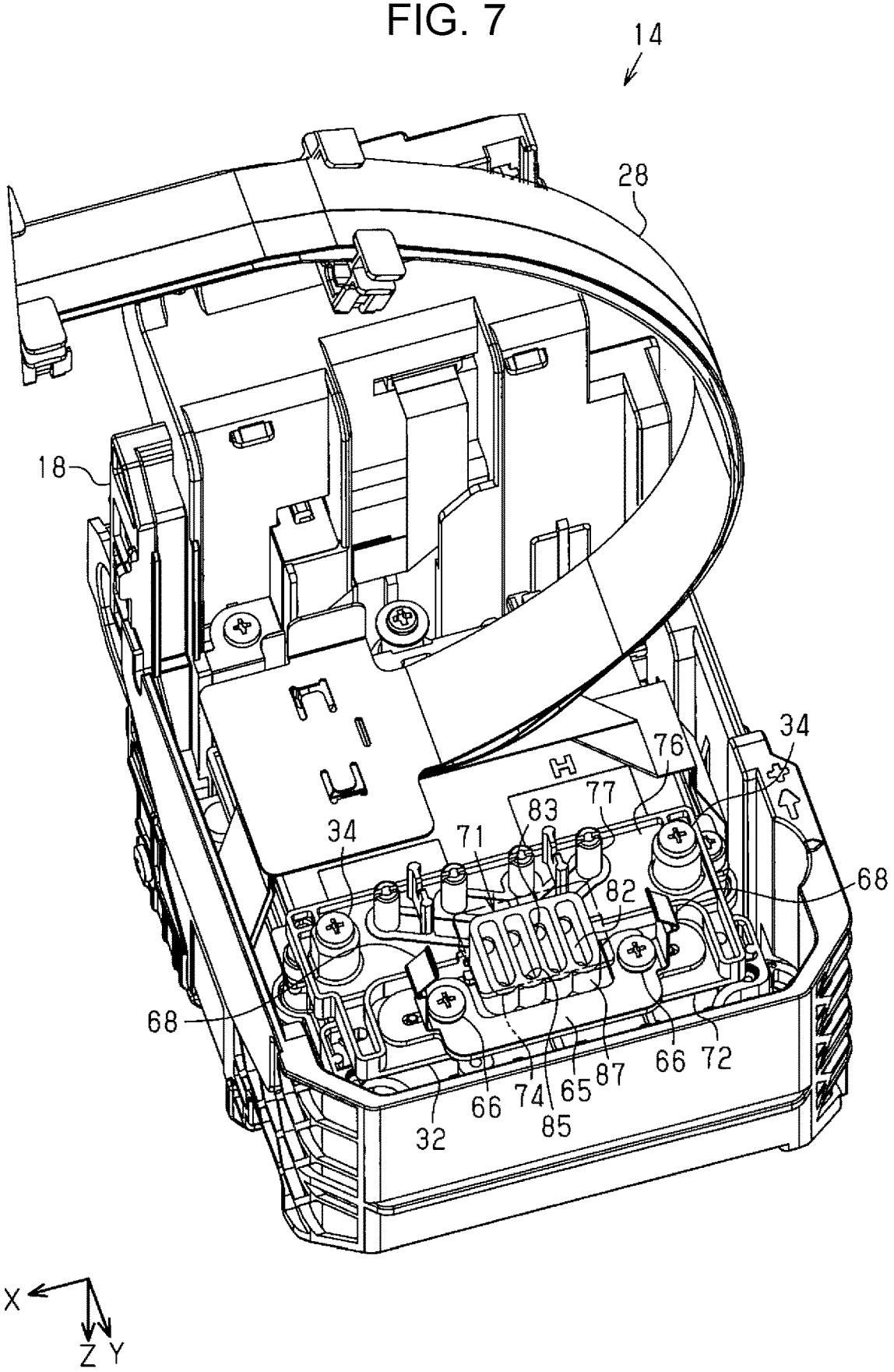
FIG. 7 is a perspective view of the carriage from which the flow channel member is detached.

As illustrated in FIGS. 2 and 7, the connection member 32 and the liquid ejecting head 19 are fixed with a screw 66 and a protective member 65 that protects the connection member 32. The connection member 32 is positioned below the flow channel member 31 in the carriage 18. The connection member 32 is fixed to the carriage 18 with the screw 34 in a state in which the liquid ejecting head 19 and the connection member are fixed.

For example, the protective member 65 is configured of steel metal. The protective member 65 has a leaf spring 68 that corresponds to a locking piece 67 provided on the holder 33 of the flow channel member 31. The leaf spring 68 is positioned at an end portion of the protective member 65 and extends toward the upper side. The locking piece 67 is hooked to the leaf spring 68, and thereby the holder 33 is temporarily locked to the connection member 32 that is fixed to the carriage 18.

The holder 33 is provided with a projection piece 69 that projects to cover, from above, the screw 66 that fixes the connection member 32 and the liquid ejecting head 19. The projection piece 69 is positioned to be adjacent to the locking piece 67 in the holder 33. The projection piece 69 makes it difficult to visually recognize the screw 66 when the inside of the carriage 18 is viewed from above. Consequently, when the flow channel member 31 is detached from the carriage 18, there is reduction in concern that the screw 66 is removed. In other words, when the flow channel member 31 is detached from the carriage 18, there is a reduction in concern that the connection member 32 is detached from the liquid ejecting head 19.

As illustrated in FIGS. 3 and 7, the connection member 32 has a flow channel 71 of a liquid. The flow channel 71 is at least a part of a flow channel for supplying the liquid to the liquid ejecting head 19. The connection member 32 has a base member 72, a first cover member 73, and a second cover member 74. The first cover member 73 and the second cover member 74 are attached to the base member 72. The first cover member 73 is welded to an undersurface 75 of the base member 72. The second cover member 74 is welded to a top surface 76 of the base member 72. The undersurface 75 and the top surface 76 are surfaces extending parallel to each other and extends horizontally in the embodiment.

The connection member 32 has a first connection tube 77 for connecting with the flow channel member 31 and a second connection tube 78 for connecting with the liquid ejecting head 19. The first connection tube 77 extends perpendicularly from the top surface 76 of the connection member 32 toward the upper side and is connected with the downstream-side connecting portion 45 of the flow channel member 31. The second connection tube 78 extends perpendicularly from the undersurface 75 of the connection member 32 toward the lower side and is connected with the liquid ejecting head 19. The flow channel 71 extends between the first connection tube 77 and the second connection tube 78.

The first cover member 73 and the second cover member 74 are attached to the base member 72, and thereby the flow channel 71 included in the connection member 32 is formed. The first cover member 73 is welded to a part of the undersurface 75 of the base member 72. The second cover member 74 is welded to a part of the top surface 76 of the base member 72. It is preferable that the first cover member 73 and the second cover member 74 be attached to the base member 72 by performing laser welding. Therefore, similar to the first flow channel forming member 47, the base member 72 is configured of a light absorbing member having absorbing properties with respect to laser light. Similar to the second flow channel forming member 48 and the third flow channel forming member 49, the first cover member 73 and the second cover member 74 are configured of a light transmitting member having transmitting properties with respect to laser light. In this manner, the undersurface 75 and the top surface 76 of the base member 72 are visually recognizable via the first cover member 73 and the second cover member 74.

The first cover member 73 and the second cover member 74 may be heat-welded to the base member 72. In this case, it is preferable that the first cover member 73 and the second cover member 74 be configured of a thin film-like member such as a film or a sheet. The first cover member 73 and the second cover member 74 may be welded by another method. It is possible to appropriately select a welding method to be employed, depending on the first cover member 73 and the second cover member 74.

When the first cover member 73 is welded to the undersurface 75 of the base member 72, an upstream-side flow channel 81, which is an upstream-side part of the flow channel 71, is formed. When the second cover member 74 is welded to the top surface 76 of the base member 72, a downstream-side flow channel 82, which is a downstream-side part of the flow channel 71, is formed. The upstream-side flow channel 81 and the downstream-side flow channel 82 are continuous via a through-channel 83 included in the base member 72. The through-channel 83 is positioned on a downstream end of the upstream-side flow channel 81 and an upstream end of the downstream-side flow channel 82. An upstream connecting channel 84 that communicates with the first connection tube 77 is provided at the upstream end of the upstream-side flow channel 81. A downstream connecting channel 85 that communicates with the second connection tube 78 is provided at the downstream end of the downstream-side flow channel 82.

The undersurface 75 and the top surface 76 of the connection member 32 are provided with ribs 86 and 87 that project perpendicularly. The ribs 86 and 87 extend to have an annular shape on the undersurface 75 and the top surface 76, respectively. The first cover member 73 and the second cover member 74 are welded to distal ends of the ribs 86 and 87, respectively, with respect to the base member 72. Therefore, distal end surfaces of the ribs 86 and 87 are welded surfaces of the base member 72 with respect to the first cover member 73 and the second cover member 74. The distal end surfaces of the ribs 86 are a part of the undersurface 75. The distal end surfaces of the ribs 87 are a part of the top surface 76. The first cover member 73 is welded to the ribs 86, and thereby the upstream-side flow channels 81 that are surrounded by the ribs 86 are formed. The second cover member 74 is welded to the ribs 87, and thereby the downstream-side flow channels 82 that are surrounded by the ribs 87 are formed.

Figure 8:
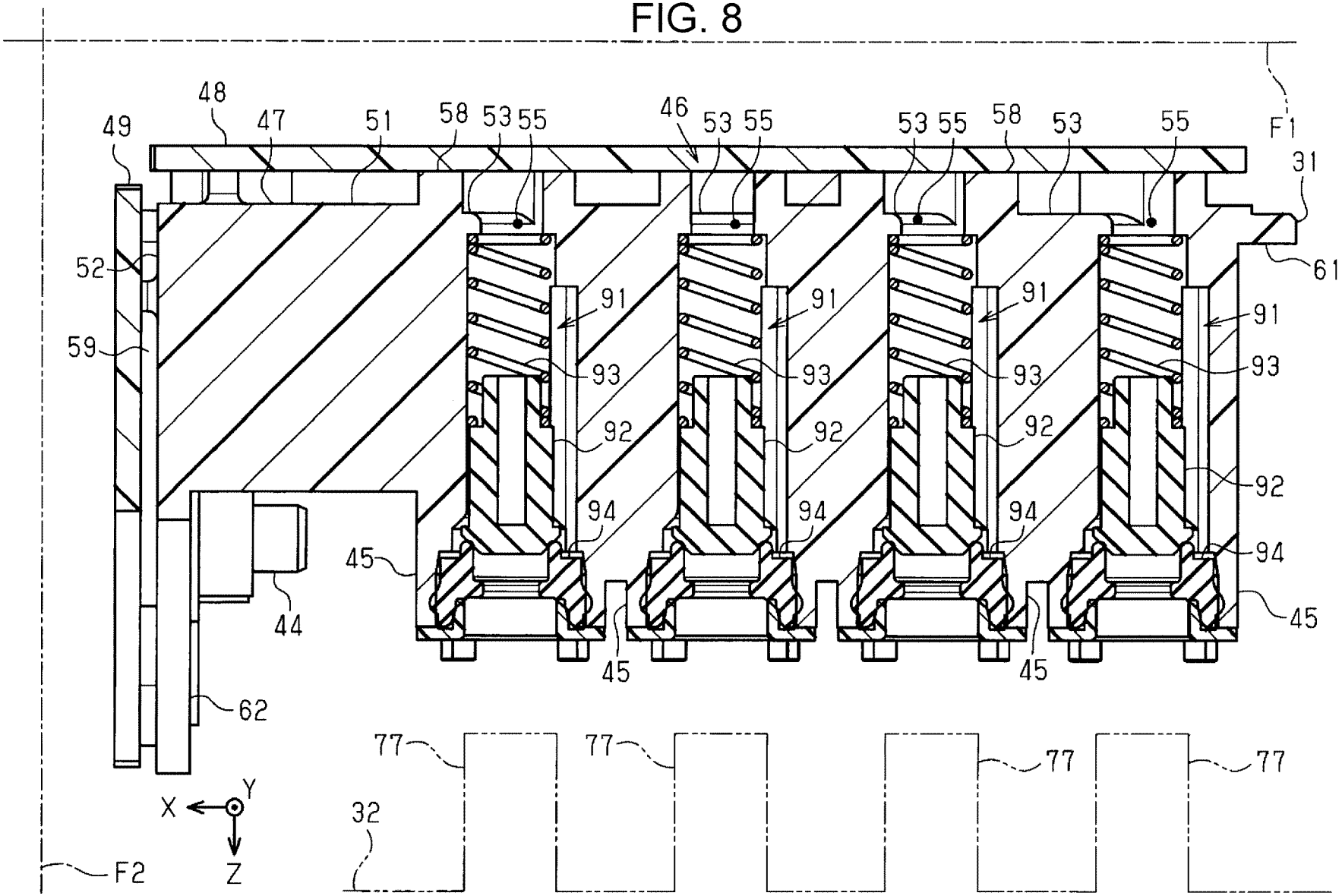
FIG. 8 is a sectional view taken along line arrow VIII-VIII in FIG. 5.

As illustrated in FIG. 8, the downstream-side connecting portion 45 that is connected with the first connection tube 77 has a leaktight mechanism 91 inside the downstream-side connecting portion. The leaktight mechanism 91 has a valve body 92, a pushing member 93, and an elastic member 94. For example, the valve body 92 is formed of a resin material, an elastomer, rubber, or the like and is movable in the downstream-side connecting portion 45. For example, the pushing member 93 is configured of a spring and pushes the valve body 92 toward a distal end of the downstream-side connecting portion 45. The elastic member 94 is configured to be elastically deformable and is formed of an elastomer, rubber, or the like. The elastic member 94 is formed to have an annular shape and is positioned close to the distal end of the downstream-side connecting portion 45 therein. The elastic member 94 comes into contact with the valve body 92 that is pushed by the pushing member 93. The valve body 92 and the elastic member 94 come into contact with each other, and thereby the downstream-side connecting portion 45 is closed. In this manner the leaktight mechanism 91 suppresses leaking of the liquid from the downstream-side connecting portion 45.

When the connection member 32 is connected with the flow channel member 31, the first connection tube 77 is inserted into the downstream-side connecting portion 45. In this case, since a plurality of first connection tubes 77 are collectively inserted into a plurality of downstream-side connecting portions 45, there is a reduction in concern that the first connection tube 77 is inserted a wrong downstream-side connecting portion 45 in which a different type of liquid flows.

When the first connection tube 77 is inserted into the downstream-side connecting portion 45, the first connection tube 77 is first inserted into the annular elastic member 94 in the downstream-side connecting portion 45. An outer circumference of the first connection tube 77 comes into contact with an inner circumference of the elastic member 94, and thereby the first connection tube is sealed by the elastic member 94. The elastic member 94 seals the first connection tube 77 in a radial direction thereof in the downstream-side connecting portion 45. An external force that is applied to the elastic member 94 when the first connection tube 77 is inserted into the elastic member 94 is determined depending on an outer diameter of the first connection tube 77 and an inner diameter of the elastic member 94. In other words, since the external force that is applied to the elastic member 94 is substantially constant regardless of an insertion amount of the first connection tube 77, the elastic member 94 has a long service lift.

When the first connection tube 77 is inserted into the downstream-side connecting portion 45 as is, the first connection tube 77 comes into contact with the valve body 92. The first connection tube 77 causes the valve body 92 to move against a pushing force of the pushing member 93. The valve body 92 is pushed by the first connection tube 77, thereby, moving from the distal end toward a proximal end of the downstream-side connecting portion 45 and being separated from the elastic member 94. When the valve body 92 and the elastic member 94 are not in contact with each other, the downstream-side connecting portion 45 is opened, and the liquid can be supplied to the first connection tube 77.

When the flow channel member 31 is detached from the connection member 32, the first connection tube 77 is pulled out from the downstream-side connecting portion 45. As the first connection tube 77 is pulled out from the downstream-side connecting portion 45, the valve body 92 moves by a pushing force of the pushing member 93 and comes into contact with the elastic member 94. Consequently, the downstream-side connecting portion 45 is closed. when the first connection tube 77 is pulled out from the downstream-side connecting portion 45 as is, the first connection tube 77 is pulled out from the elastic member 94. In other words, the elastic member 94 causes the first connection tube 77 to be released from sealing. As described above, the leaktight mechanism 91 suppresses leaking of the liquid during attachment and detachment of the flow channel member 31 to and from the connection member 32.

The first surface 51 and the fourth surface 61 extend parallel to each other in the first flow channel forming member 47. The second surface 52 and the third surface 62 extend parallel to each other. In consideration of a virtual plane F1 extending along the first surface 51 and the fourth surface 61 and a virtual plane F2 extending along the second surface 52 and the third surface 62, the virtual plane F1 and the virtual plane F2 intersect with each other.

Next, a method for manufacturing the flow channel member 31 configured as described above will be described.

Figure 9:
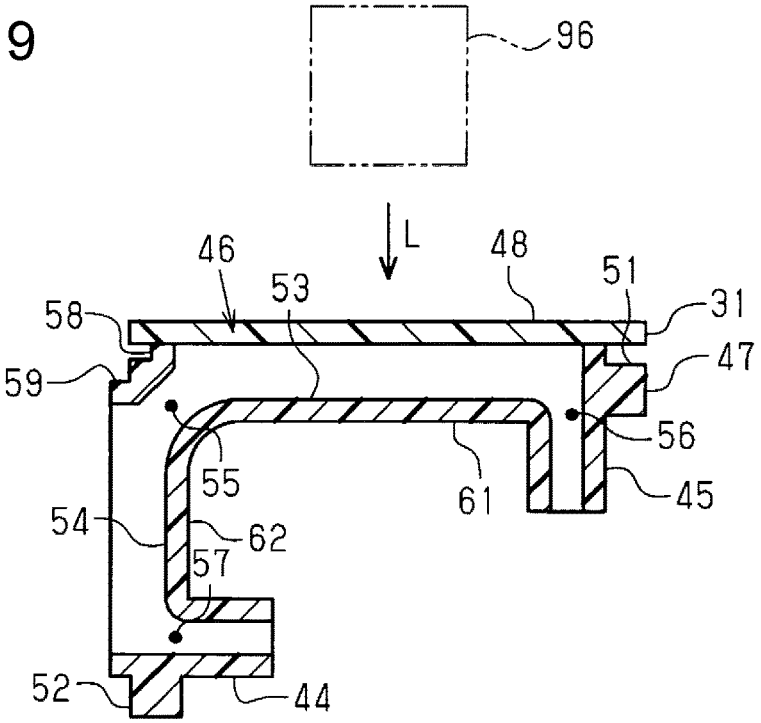
FIG. 9 is a sectional view schematically illustrating a first disposing step and a first irradiating step.

As illustrated in FIG. 9, first, the first surface 51 of the first flow channel forming member 47 is disposed to come into contact with the second flow channel forming member 48. In the embodiment, a distal end of the rib 58 of the first surface 51 is disposed to come into contact with the second flow channel forming member 48. Such disposition is referred to as a first disposing step.

After the first surface 51 of the first flow channel forming member 47 is disposed to come into contact with the second flow channel forming member 48, a position, at which the first surface 51 of the first flow channel forming member 47 come into contact with the second flow channel forming member 48, is irradiated with the laser light L from a light source device 96. In the embodiment, irradiation with the laser light L is performed along the ribs 58. The irradiation with the laser light L is referred to as a first irradiating step. In other words, after the first disposing step is executed, the first irradiating step is executed.

The laser light L, with which the irradiation is performed, is transmitted through the second flow channel forming member 48 configured of the light transmitting member and is absorbed by the first flow channel forming member 47 configured of the light absorbing member. When the first flow channel forming member 47 absorbs the laser light L, heat is generated. The first flow channel forming member 47 and the second flow channel forming member 48 melt by the heat and are welded to each other.

Figure 10:
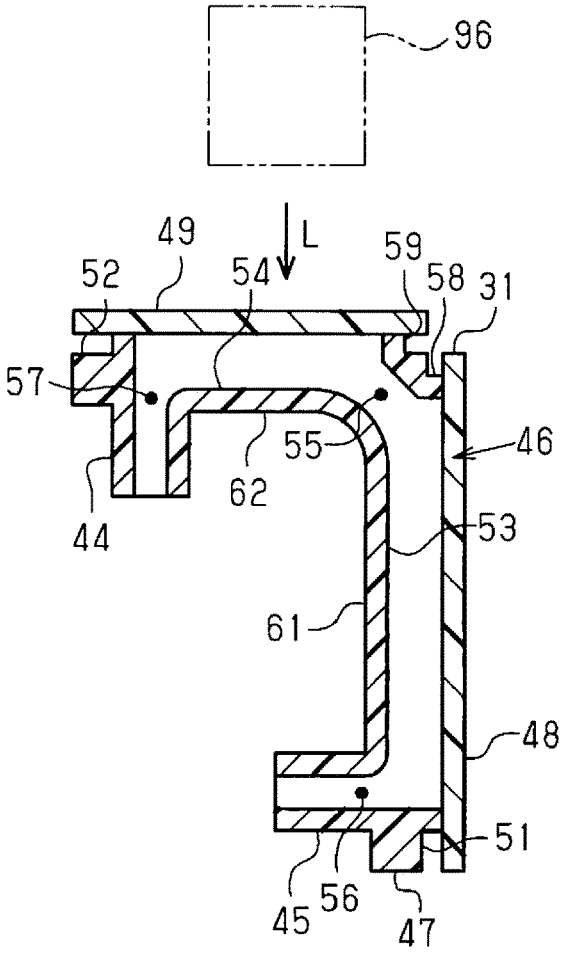
FIG. 10 is a sectional view schematically illustrating a second disposing step and a second irradiating step.

Next, as illustrated in FIG. 10, the second surface 52 of the first flow channel forming member 47 is disposed to come into contact with the third flow channel forming member 49. In the embodiment, a distal end of the rib 59 of the second surface 52 is disposed to come into contact with the third flow channel forming member 49. Such disposition is referred to as a second disposing step.

After the second surface 52 of the first flow channel forming member 47 is disposed to come into contact with the third flow channel forming member 49, a position, at which the second surface 52 of the first flow channel forming member 47 comes into contact with the third flow channel forming member 49, is irradiated with the laser light L from the light source device 96. In the embodiment, irradiation with the laser light L is performed along the ribs 59. The irradiation with the laser light L is referred to as a second irradiating step. In other words, after the second disposing step is executed, the second irradiating step is executed.

The laser light L, with which the irradiation is performed, is transmitted through the third flow channel forming member 49 configured of the light transmitting member and is absorbed by the first flow channel forming member 47 configured of the light absorbing member. The first flow channel forming member 47 absorbs the laser light L, and thereby heat is generated. In this manner, the first flow channel forming member 47 and the second flow channel forming member 48 melt and are welded to each other.

When the flow channel member 31 is manufactured, the second flow channel forming member 48 may be welded after the third flow channel forming member 49 is welded to the first flow channel forming member 47. In other words, after the second disposing step and the second irradiating step are executed, the first disposing step and the first irradiating step may be executed.

It is preferable to use a device using a galvano mirror as the light source device 96. It is possible to more reduce unevenness of welding by the laser welding, compared to another welding method such as heat welding, ultrasound welding, or welding with an adhesive. In a case where the flow channel member 31 is formed by the laser welding, it is possible to employ a plate-shaped member having a thickness as the second flow channel forming member 48 and the third flow channel forming member 49. Therefore, it is possible to more improve durability of the flow channel member 31, compared to a case where a film-like or sheet-like member is employed as the second flow channel forming member 48 and the third flow channel forming member 49.

Next, operations and effects of the liquid ejecting apparatus 11 that includes the flow channel member 31 configured as described above will be described.

(1) The flow channel 46 of the flow channel member 31 is formed by the first flow channel forming member 47 which is configured of the light absorbing member and the second flow channel forming member 48 and the third flow channel forming member 49 which are configured of the light transmitting member. The second flow channel forming member 48 and the third flow channel forming member 49 are welded to the first surface 51 and the second surface 52 in the first flow channel forming member 47, respectively. The first surface 51 and the second surface 52 are surfaces facing different directions from each other in the first flow channel forming member 47. Of the flow channel 46 of the flow channel member 31, it is possible to visually recognize the first flow channel 53 via the second flow channel forming member 48 from a side facing the first surface 51, and it is possible to visually recognize the inside of the second flow channel 54 via the third flow channel forming member 49 from a side facing the second surface 52. Hence, it is possible to visually recognize the inside of the flow channel 46 from a plurality of directions.

(2) Since the first surface 51 faces upward, it is possible to visually recognize the inside of the first flow channel 53 from above from which it is relatively easy to view the inside. Consequently, it is possible to visually recognize the inside of the flow channel 46 easily.

(3) In a case where bubbles are present in the liquid in the flow channel 46, the bubbles move upward due to buoyance. The first surface 51 is provided above the second surface 52 in the vertical direction Z. In other words, since the first surface 51 is provided above the second surface 52 in the flow channel member 31, the second flow channel 54 constituting the upstream-side part of the flow channel 46 extends upward in the vertical direction Z. Consequently, the bubbles that flow in the second flow channel 54 are likely to move to the first flow channel 53 that is easy to be viewed from above. Consequently, it is possible to visually recognize the bubbles in the flow channel 46 easily.

(4) Since the downstream-side connecting portion 45 is positioned below the first surface 51, it is difficult for the bubbles in the flow channel 46 to flow to the downstream-side connecting portion 45. Consequently, it is possible to accumulate the bubbles in the first flow channel 53.

(5) Since the upstream-side connecting portion 44 is positioned on the third surface 62 on the opposite side to the second surface 52, it is possible to easily cause the bubbles in the upstream region from the flow channel 46 of the flow channel member 31 to flow into the second flow channel 54. Consequently, it is possible to visually recognize the bubbles in the flow channel 46 easily.

(6) The downstream-side connecting portion 45 is connected to one end of the supply flow channel (first connection flow channel) 23 of which the other end is connected to the liquid ejecting head 19. The upstream-side connecting portion 44 is connected to one end of the connection member (second connection flow channel) 32 of which the other end is connected to the liquid container 15 that contains the liquid. Therefore, it is possible to apply the flow channel member 31 as a part of the flow channel from the liquid container 15 to the liquid ejecting head 19.

The embodiments described above may be modified as the following modification examples. In addition, any configuration included in the embodiment and any configuration included in the following modification examples may be combined, or any configurations included in the following modification examples may be combined.

Figure 11:
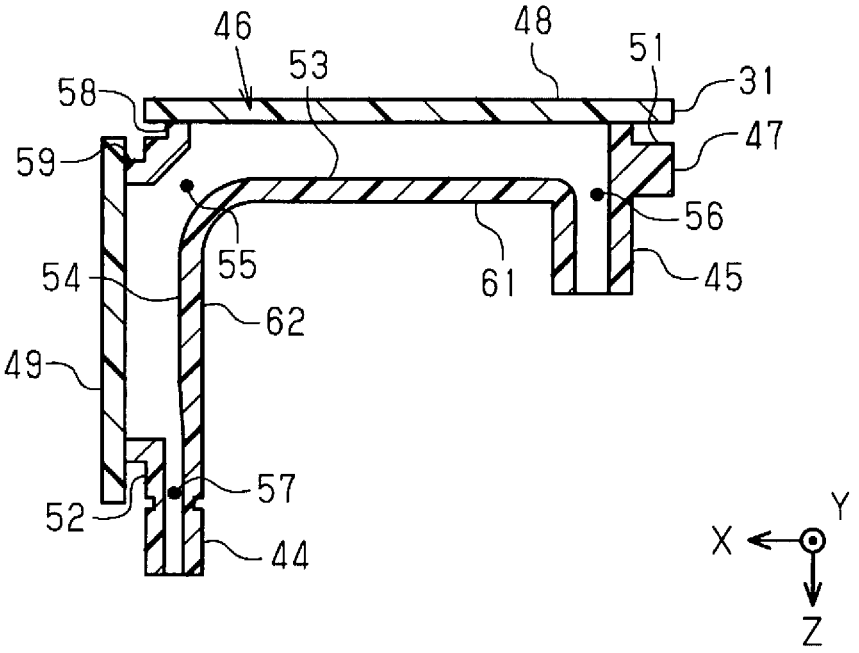
FIG. 11 is a sectional view schematically illustrating a first modification example in the flow channel member.

As illustrated in FIG. 11, the upstream-side connecting portion 44 may positioned below the second surface 52 in the vertical direction Z. In this case, the upstream-side connecting portion 44 extends from the first flow channel forming member 47 toward the lower side in the vertical direction Z. The upstream-side connecting portion 44 extend to communicates with the second surface 52 and the third surface 62. According to the modification examples, it is possible to obtain the following effects.

(7) Since the upstream-side connecting portion 44 is located at a position below the second surface 52, it is possible to easily cause the bubbles in the upstream region from the flow channel of the flow channel member 31 to flow into the second flow channel 54. Consequently, it is possible to visually recognize the bubbles in the flow channel 46 easily.

Figure 12:
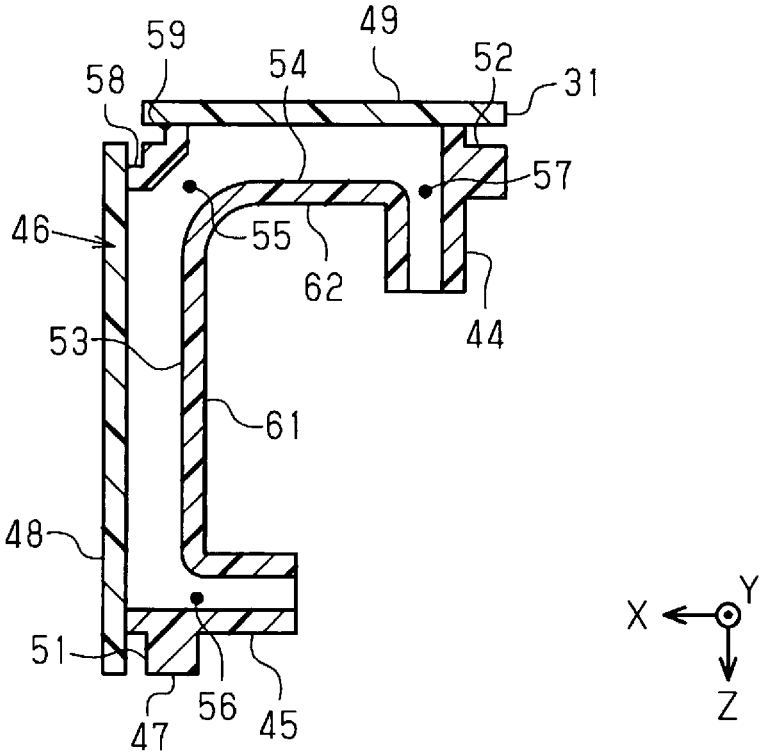
FIG. 12 is a sectional view schematically illustrating a second modification example in the flow channel member.

As illustrated in FIG. 12, the flow channel member 31 may be disposed so as to cause the second surface 52 to face upward in the vertical direction Z. In this manner, in a case where the flow channel member 31 is viewed from above, it is possible to visually recognize the bubbles in the second flow channel 54 easily. Since the first flow channel 53 extends from the upper side toward the lower side, it is difficult for the bubbles to flow from the second flow channel 54 into the first flow channel 53. In other words, it is possible to accumulate the bubbles in the second flow channel 54.

Figure 13:
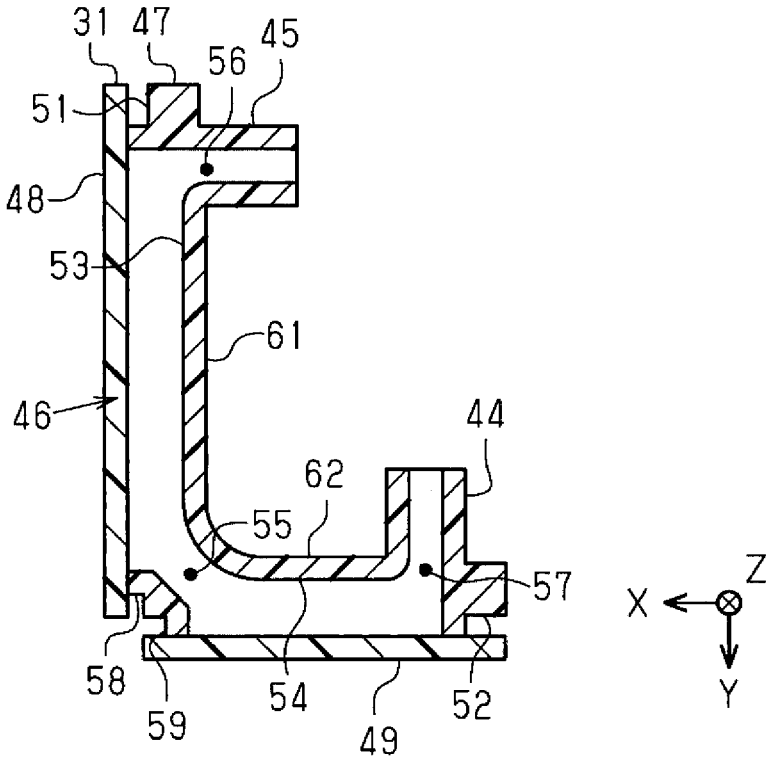
FIG. 13 is a sectional view schematically illustrating a third modification example in the flow channel member.

As illustrated in FIG. 13, the flow channel member 31 may be disposed to cause the first surface 51 to face the opposite home side in the width direction X and the second surface 52 to face the downstream side in the transport direction Y. In other words, the flow channel member 31 may be disposed so as not to cause any of the first surface 51 and the second surface 52 to face upward in the vertical direction Z.

The flow channel member 31 is not limited to dispositions described in the above-described embodiment and modification examples. For example, the flow channel member 31 may be disposed to cause the third surface 62 to face upward in the vertical direction Z or to cause the fourth surface 61 to face upward in the vertical direction Z. The disposition of the flow channel member 31 may be freely determined.

Figure 14:
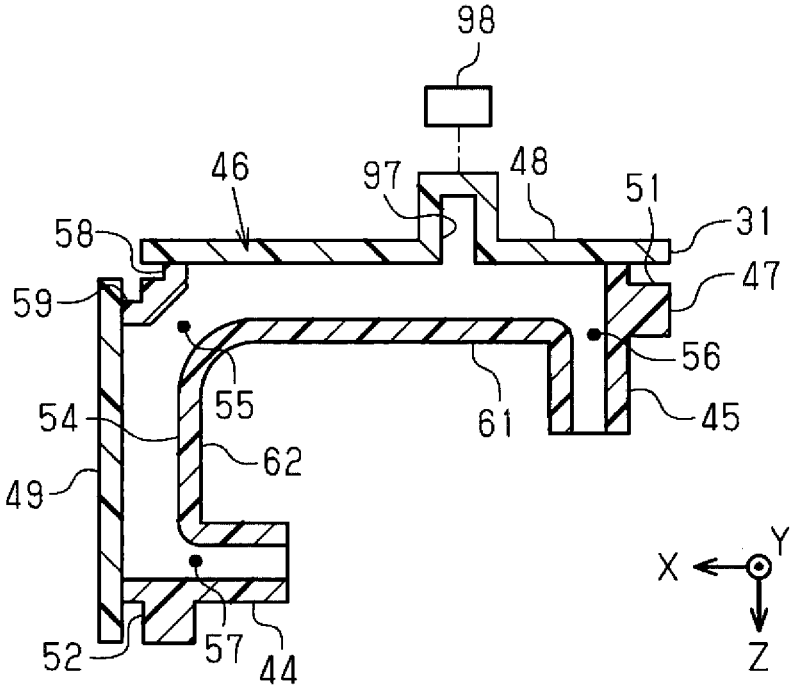
FIG. 14 is a sectional view schematically illustrating a fourth modification example in the flow channel member.

As illustrated in FIG. 14, a bubble trapping portion 97 for trapping bubbles may be provided at a position in the middle of the flow channel 46. For example, the bubble trapping portion 97 is a space in which the bubbles can be accumulated. A part in which a route increases may be provided at a position in the middle of the flow channel 46, the part may be used as the bubble trapping portion 97. It is preferable that the bubble trapping portion 97 be provided in the flow channel 46 that is formed on a surface of the flow channel member 31, which faces upward in the vertical direction Z. In a modification example illustrated in FIG. 14, since the first surface 51 faces upward in the vertical direction Z, the bubble trapping portion 97 is provided in the first flow channel 53. The bubble trapping portion 97 is formed in the second flow channel forming member 48. In a case where the flow channel member 31 is disposed so as to cause the second surface 52 to face upward in the vertical direction Z, the bubble trapping portion 97 may be provided in the second flow channel 54.

As illustrated in FIG. 14, a detector 98 that is capable of detecting a bubble may be provided. For example, the detector 98 is configured of an optical sensor, an ultrasound sensor, or the like, for example. It is preferable that the detector 98 be provided to detect a bubble in the flow channel 46 that is formed on the surface of the flow channel member 31, which faces upward in the vertical direction Z. In other words, the detector 98 may be disposed at a position facing the surface of the flow channel member 31, which faces upward in the vertical direction Z. In the modification example illustrated in FIG. 14, since the first surface 51 faces upward in the vertical direction Z, the detector 98 is positioned to face the first surface 51.

In a case where the flow channel member 31 has the bubble trapping portion 97, it is preferable that the detector 98 be disposed to detect a bubble in the bubble trapping portion 97. In a case where the detector 98 is the optical sensor, a reflective sheet, from which the light is reflected, may be disposed in the flow channel 46. In this manner, detection accuracy by the detector 98 improves. Based on a detection result of the detector 98, the cleaning such as pressurization cleaning or suction cleaning may be executed in the configuration. Based on the detection result of the detector 98, appropriate cleaning may be selected and executed in the configuration.

The connection member 32 may be a tube.

The first surface 51 and the second surface 52 may not be provided with the ribs 58 and the ribs 59, respectively. For example, instead of the ribs 58 and 59, grooves for forming the flow channel 46 may be provided in the first surface 51 and the second surface 52, respectively.

The second flow channel 54 may be formed integrally by the first flow channel forming member 47. In other words, the flow channel member 31 may have a configuration in which the laser welding is executed only by the first surface 51.

The flow channel member 31 may be employed in a line head printer in which the liquid ejecting head 19 is elongated in the width direction X. The flow channel member 31 may be employed in a lateral printer in which the liquid ejecting head 19 is movable in the width direction X and the transport direction Y.

The medium S is not limited to a sheet of paper, may be a plastic film, a thin plate material, or the like, or may be cloth used in a textile printing apparatus or the like. The medium S may be clothes or the like having an optional shape such as T-shirt or may be a three-dimensional object having an optional shape such as tableware or stationery.

The liquid ejected by the liquid ejecting head 19 is not limited to ink and may be a liquid body in which particles of functional materials are dispersed or mixed in a liquid, for example. For example, the liquid ejecting head 19 may eject a liquid body containing, in a dispersing or dissolving manner, a material such as an electrode material or color material (pixel material) which is used in manufacturing or the like of a liquid crystal display, an electroluminescence (EL) display, and a field emission display.

Hereinafter, a technical idea, which is known from the embodiment and the modification examples described above, and operation effects thereof will be described.

Idea 1

There is provided a flow channel member in which a flow channel of a liquid is formed by a plurality of flow channel forming members, the flow channel member including: a first flow channel forming member that includes a light absorbing member having absorbing properties with respect to laser light; a second flow channel forming member that includes a light transmitting member having transmitting properties with respect to the laser light and is welded to a first surface of the first flow channel forming member to form a first flow channel that is a downstream-side part of the flow channel; and a third flow channel forming member that includes a light transmitting member having transmitting properties with respect to the laser light and is welded to a second surface of the first flow channel forming member to form a second flow channel that is an upstream-side part of the flow channel, in which the first surface and the second surface are provided at positions where planes along the both surfaces intersect with each other.

In this configuration, of the flow channel of the flow channel member, it is possible to visually recognize the first flow channel via the second flow channel forming member from a side facing the first surface, and it is possible to visually recognize the second flow channel via the third flow channel forming member from a side facing the second surface. Hence, it is possible to visually recognize the inside of the flow channel from a plurality of directions.

Idea 2

There is provided a liquid ejecting apparatus including: a liquid ejecting head that ejects a liquid; and a flow channel member in which at least a part of a flow channel of the liquid that is supplied to the liquid ejecting head is formed by a plurality of flow channel forming members, in which the flow channel member includes a first flow channel forming member that includes a light absorbing member having absorbing properties with respect to laser light, a second flow channel forming member that includes a light transmitting member having transmitting properties with respect to the laser light and is welded to a first surface of the first flow channel forming member to form a first flow channel that is a downstream-side part of the flow channel, and a third flow channel forming member that includes a light transmitting member having transmitting properties with respect to the laser light and is welded to a second surface of the first flow channel forming member to form a second flow channel that is an upstream-side part of the flow channel, and the first surface and the second surface are provided at positions where planes along the both surfaces intersect with each other.

In this configuration, it is possible obtain the same effect as those of Idea 1.

Idea 3

In the liquid ejecting apparatus according to Idea 2, the first surface faces upward in a vertical direction.

In this configuration, since the first surface faces upward, it is possible to visually recognize the inside of the first flow channel from above from which it is relatively easy to view the inside. Consequently, it is possible to visually recognize the inside of the flow channel easily.

Idea 4

In the liquid ejecting apparatus according to Idea 3, the first surface is provided above the second surface in the vertical direction.

In this configuration, in a case where bubbles are present in the liquid in the flow channel, the bubbles move upward due to buoyance. Since the first surface is provided above the second surface in the flow channel member, the second flow channel constituting the upstream-side part of the flow channel extends vertically upward. Consequently, the bubbles that flow in the second flow channel are likely to move to the first flow channel that is easy to be viewed from above. Consequently, it is possible to visually recognize the bubbles in the flow channel easily.

Idea 5

In the liquid ejecting apparatus according to Idea 3 or 4, the first flow channel forming member has a downstream-side connecting portion that communicates with a downstream side of the first flow channel, and the downstream-side connecting portion is positioned below the first surface in the vertical direction.

In this configuration, since the downstream-side connecting portion is positioned below the first surface, it is possible to accumulate the bubbles in the first flow channel.

Idea 6

In the liquid ejecting apparatus according to Idea 5, the first flow channel forming member has an upstream-side connecting portion that communicates with an upstream side of the second flow channel, and the upstream-side connecting portion is positioned below the second surface in the vertical direction or is positioned on a third surface of the first flow channel forming member that is on an opposite side to the second surface.

In this configuration, since the upstream-side connecting portion is positioned below the second surface or is positioned on the third surface on the opposite side to the second surface, it is possible to easily cause the bubbles in an upstream region from the flow channel of the flow channel member to flow into the second flow channel. Consequently, it is possible to visually recognize the bubbles in the flow channel easily.

Idea 7

In the liquid ejecting apparatus according to Idea 6, the downstream-side connecting portion is connected to one end of a first connection flow channel of which the other end is connected to the liquid ejecting head, and the upstream-side connecting portion is connected to one end of a second connection flow channel of which the other end is connected to a liquid container that contains a liquid.

In this configuration, it is possible to apply the flow channel member as a part of the flow channel from the liquid container to the liquid ejecting head.

Idea 8

There is provided a method for manufacturing a flow channel member having a flow channel of a liquid by laser-welding a plurality of flow channel forming members, the method including: disposing a first surface of a first flow channel forming member that includes a light absorbing member having absorbing properties with respect to laser light and a second flow channel forming member that includes a light transmitting member having transmitting properties with respect to the laser light to come into contact with each other; irradiating the laser light from a light source device to a position where the first surface and the second flow channel forming member come into contact with each other after disposing the first surface and the second flow channel forming member to be in a state of coming into contact with each other; disposing a second surface of a first flow channel forming member provided along a plane intersecting with a plane along the first surface and a third flow channel forming member that includes a light transmitting member having transmitting properties with respect to the laser light to come into contact with each other; and irradiating the laser light from the light source device to a position where the second surface and the third flow channel forming member come into contact with each other after disposing the second surface and the third flow channel forming member to be in a state of coming into contact with each other.

According to the method, it is possible to form the flow channel member in which it is possible to visually recognize the inside of the flow channel in a plurality of directions.

The entire disclosure of Japanese Patent Application No. 2017-240331, filed Dec. 15, 2017 is expressly incorporated by reference herein.

What is claimed is:

1. A flow channel member in which a flow channel of a liquid is formed by a plurality of flow channel forming members, the flow channel member comprising:

a first flow channel forming member that includes a light absorbing member having absorbing properties with respect to laser light;

a second flow channel forming member that includes a light transmitting member having transmitting properties with respect to the laser light and is welded to a first surface of the first flow channel forming member to form a first flow channel that is a downstream-side part of the flow channel; and a third flow channel forming member that includes a light transmitting member having transmitting properties with respect to the laser light and is welded to a second surface of the first flow channel forming member to form a second flow channel that is an upstream-side part of the flow channel, wherein the first surface and the second surface are provided at positions where planes along the both surfaces intersect with each other.

2. A liquid ejecting apparatus comprising:

a liquid ejecting head that ejects a liquid; and a flow channel member in which at least a part of a flow channel of the liquid that is supplied to the liquid ejecting head is formed by a plurality of flow channel forming members, wherein the flow channel member includes a first flow channel forming member that includes a light absorbing member having absorbing properties with respect to laser light, a second flow channel forming member that includes a light transmitting member having transmitting properties with respect to the laser light and is welded to a first surface of the first flow channel forming member to form a first flow channel that is a downstream-side part of the flow channel, and a third flow channel forming member that includes a light transmitting member having transmitting properties with respect to the laser light and is welded to a second surface of the first flow channel forming member to form a second flow channel that is an upstream-side part of the flow channel, and wherein the first surface and the second surface are provided at positions where planes along the both surfaces intersect with each other.

3. The liquid ejecting apparatus according to claim 2, wherein the first surface faces upward in a vertical direction.

4. The liquid ejecting apparatus according to claim 3, wherein the first surface is provided above the second surface in the vertical direction.

5. The liquid ejecting apparatus according to claim 3, wherein the first flow channel forming member has a downstream-side connecting portion that communicates with a downstream side of the first flow channel, and wherein the downstream-side connecting portion is positioned below the first surface in the vertical direction.

6. The liquid ejecting apparatus according to claim 5, wherein the first flow channel forming member has an upstream-side connecting portion that communicates with an upstream side of the second flow channel, and wherein the upstream-side connecting portion is positioned below the second surface in the vertical direction or is positioned on a third surface of the first flow channel forming member that is on an opposite side to the second surface.

7. The liquid ejecting apparatus according to claim 6, wherein the downstream-side connecting portion is connected to one end of a first connection flow channel of which the other end is connected to the liquid ejecting head, and wherein the upstream-side connecting portion is connected to one end of a second connection flow channel of which the other end is connected to a liquid container that contains a liquid.

8. A method for manufacturing a flow channel member having a flow channel of a liquid by laser-welding a plurality of flow channel forming members, the method comprising:

disposing a first surface of a first flow channel forming member that includes a light absorbing member having absorbing properties with respect to laser light and a second flow channel forming member that includes a light transmitting member having transmitting properties with respect to the laser light to come into contact with each other;

irradiating the laser light from a light source device to a position where the first surface and the second flow channel forming member come into contact with each other after disposing the first surface and the second flow channel forming member to be in a state of coming into contact with each other;

disposing a second surface of a first flow channel forming member provided along a plane intersecting with a plane along the first surface and a third flow channel forming member that includes a light transmitting member having transmitting properties with respect to the laser light to come into contact with each other; and irradiating the laser light from the light source device to a position where the second surface and the third flow channel forming member come into contact with each other after disposing the second surface and the third flow channel forming member to be in a state of coming into contact with each other.

* * * * *